United States Patent [19]

Malik

[11] Patent Number: 4,579,307

[45] Date of Patent: Apr. 1, 1986

[54] WIRE RACK FOR PLASTIC BAG

[76] Inventor: James J. Malik, 6618 Bennington Dr., Parma Heights, Ohio 44130

[21] Appl. No.: 687,197

[22] Filed: Dec. 28, 1984

[51] Int. Cl.[4] ..... A63B 55/04

[52] U.S. Cl. ..... 248/99; 248/97; 211/181

[58] Field of Search ..... 248/99, 100, 101, 175, 248/97, 98, 95, 165; 211/169, 181

[56] References Cited

U.S. PATENT DOCUMENTS

| | | | |
|---|---|---|---|
| 514,182 | 2/1894 | English | 248/175 |
| 1,773,927 | 8/1930 | Mills | 248/99 |
| 2,621,878 | 12/1952 | Kruger | 248/175 |
| 4,398,689 | 8/1983 | Prader | 248/99 |
| 4,458,867 | 7/1984 | Malik | 248/99 |

*Primary Examiner*—Reinaldo P. Machado
*Assistant Examiner*—Alvin Chin-Shue
*Attorney, Agent, or Firm*—Alfred D. Lobo

[57] ABSTRACT

A wire rack is specifically adapted to hold a plastic bag open by its integral handle-loops, without making welds to provide journal means in which swing panels supporting the bag are swingably disposed. The rack which requires no base comprises a spacer frame which maintains at least two vertical mounting posts in horizontally spaced apart relationship with each other. The frame is mounted to a wall. Each swing panel is journalled in each mounting post which provides upper and lower wire "journalling loops", each in a horizontal plane. The journalling loops which are formed to closely wrap around the wire of a swing panel, obviate the need for welding any journal means to the wire stock of each mounting post. Each post also includes a forward-projecting U-shaped "post loop" in a horizontal plane, which in cooperation with a forward-projecting U-shaped panel loop, allows each swing panel to be locked in a bag-loading position with a plastic tube which snugly fits over both loops. To ship the wire rack, the swing panels are unlocked. The spacer frame may be extended to include several mounting posts, the number required being one more than the number of bags to be loaded substantially simultaneously.

4 Claims, 7 Drawing Figures

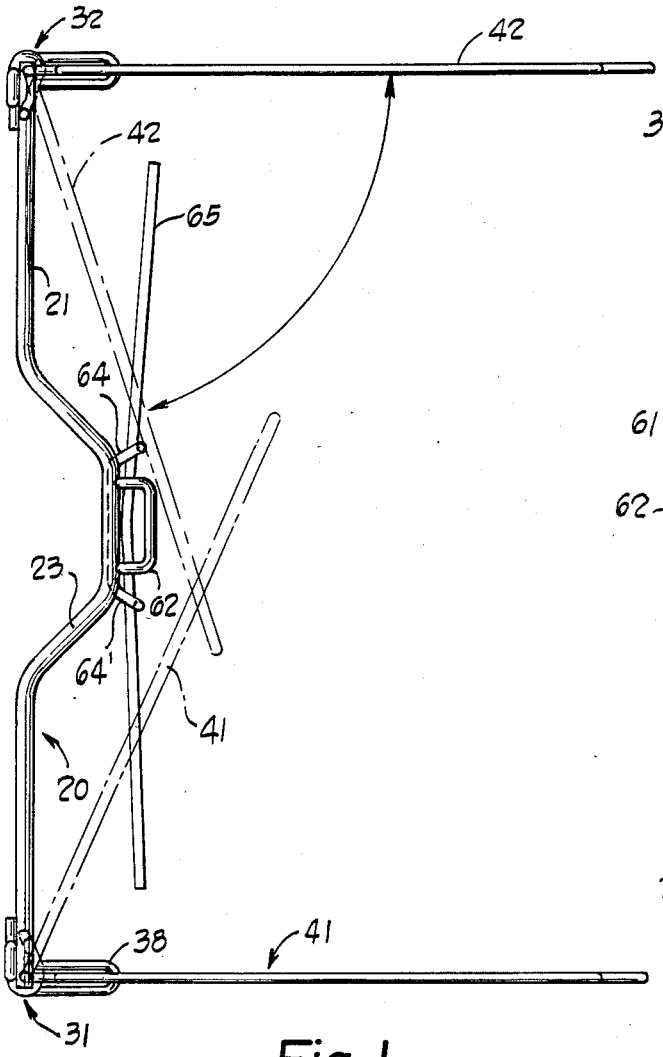
Fig. 1
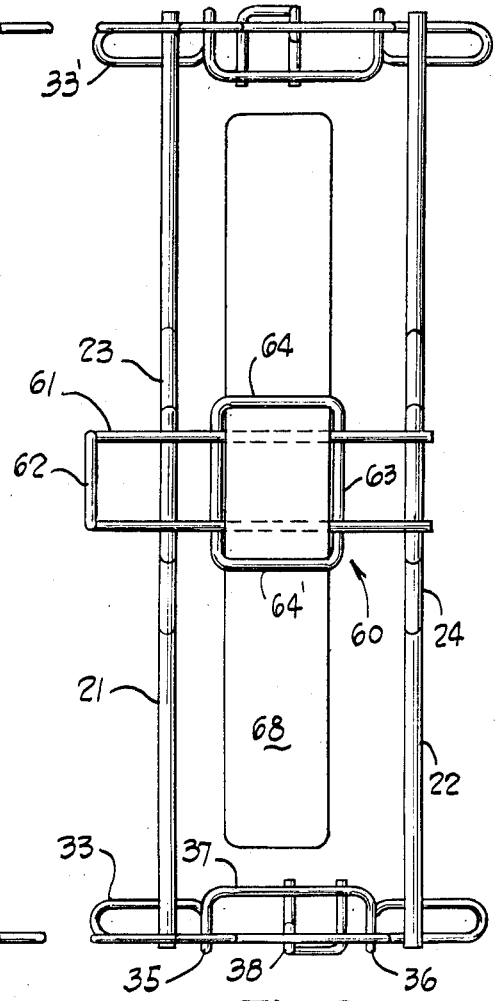
Fig. 2
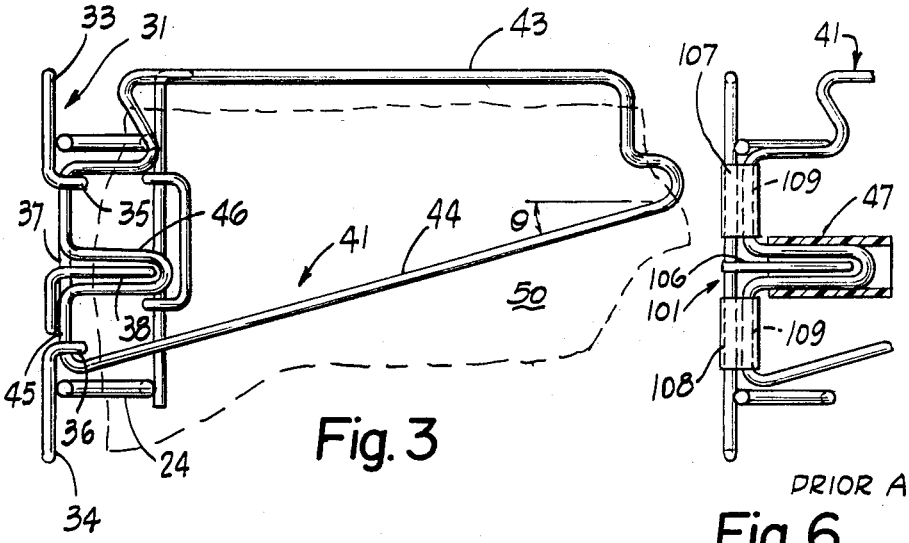
Fig. 3
PRIOR ART
Fig. 6
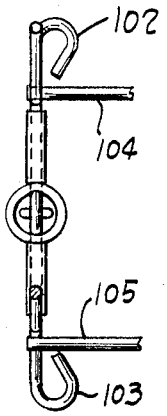
Fig. 7

WIRE RACK FOR PLASTIC BAG

BACKGROUND OF THE INVENTION

This invention relates to a class of articles or devices made from wire to provide a frame which is not a stand, the frame holding the mouth of a bag open while the bag is suspended within the frame without prongs, hooks or clamps, and without supporting the body of the bag.

Wire racks have attained a high degree of commercial acceptance because of the relative ease with which they may be fabricated, the low cost of wire stock and the short time required to fabricate them. Such racks are particularly popular for relatively small and light objects which must be displayed prominently; and to save storage space, such racks are collapsible as shown in my U.S. Pat. No. 3,726,415. Such racks are not generally regarded favorably for heavy duty applications, referred to as such because in such applications, these racks are subjected to rough treatment if not outright abuse.

To place my wire rack of this invention in service, it is wall mounted, or mounted on a vertical panel such as is placed adjacent a checkout counter in a grocery store, or any other conveniently accessible vertical surface. My wire rack serves substantially the same function as the bag support system disclosed in U.S. Pat. No. 4,332,361. However, such a system has several drawbacks for heavy duty service in a grocery store, among which drawbacks is the fragility of the welded tabs by which the supporting frames are mounted. Treated roughly, the welded joints between the tabs and the frames, which are typically resistance welded, are prone to failure. Having discovered this problem with wire racks made with resistance welds, the problem was to construct a functional and economical rack without using welds at critical locations where they are subject to high stress.

The device of this invention is particularly directed to the use of a plastic bag with integral handle loops. Such plastic bags are now conventionally used as grocery bags in which foodstuffs are packed, or shopping bags in which various articles are loaded so that the bags may then be conveniently hand-carried in one hand. Such a bag is described in greater detail in U.S. Pat. No. 4,062,170 the disclosure of which is incorporated by reference thereto as if fully set forth herein, which patent also discloses an apparatus for loading such a bag. A wire rack which achieves the same purpose more simply, reliably and economically is disclosed in my U.S. Pat. No. 4,458,867.

Racks used to hold grocery bags open while they are filled belong in the heavy duty category. It is common experience that groceries including canned goods and the like are loaded into a grocery bag with the emphasis on haste rather than care. As a result, a device such as is shown in the '170 patent was initially made of heavy steel sheet metal. Not surprisingly, the cost of fabricating such devices was discouragingly high considering the economics of the circumstances surrounding their use, and much energy and time was devoted to finding a more economical way.

It eventually became evident that economies in fabrication could be effected if the rack was made of wire for the most part, and such a rack was constructed with double-barreled resistance welded sheet metal journals in which swing panels were journalled, as will be described hereinbelow. When the rack was placed in service, it produced unexpectedly discouraging results. The racks broke where the sheet metal journals were welded to the wire stock due to the stress generated by loading the bags held open on the swing panels which were journalled for swinging movement in the sheet metal journals (as will be described more fully hereinbelow)

As is well known, the cost of welding in the fabrication of any article is a substantial cost, and it is in the interest of economy to use the least expensive method of welding which will provide the desired strength. As wire stock from an adequately sturdy rack is made is typically about 0.25" (inch) or 6.35 mm in diameter, or less, resistance welding is the most practical method of fabrication. Since such welds were less than reliable in service, arc welding the sheet metal journals to the wire stock of the rack was tested, but the arc welded weldments were still unsatisfactory for one reason or another, and the cost of the racks became prohibitive. Since mechanical fastening means were both inapposite and uneconomical, it appeared that the discouraging economics of fabrication of the wall mountable wire racks would have to be tolerated.

Since the reality of the marketplace dictates that the cost of supplying suitable racks, for use in holding plastic bags open, is to be met from the profits of selling the bags, it is essential that the cost of the racks be minimized.

The wall-mountable wire rack of my invention has succeeded in minimizing cost yet improving performance.

SUMMARY OF THE INVENTION

An improved design for a wire rack specifically adapted to hold a plastic bag open by its integral handle-loops, obviates the necessity of making welds to provide journal means in which swing panels are swingably disposed. The rack which requires no base because the bag to be loaded hangs from left and right vertical swing panels, comprises a spacer frame which maintains at least two vertical mounting posts in horizontally spaced apart relationship with each other; and a swing panel journalled in each mounting post which provides upper and lower wire loops (referred to as "journalling loops") each in a horizontal plane, in which journalling loops the swing panel is journalled. The journalling loops obviate the need for welding any journal means to the wire stock of each mounting post. Each post also includes a forward projecting U-shaped loop in a horizontal plane (referred to as a "post loop") which post loop is formed intermediate the upper and lower journalling loops for the purpose of locking the swing panels in a bag-loading position. Each swing panel comprises a single piece of wire forming a continuous loop bent to provide a tab-shaped horizontal upper portion to engage a handle loop of the plastic bag, a lower portion, downwardly inclined from the horizontal at an angle less than 45°; and, a posterior vertical portion journalled in the upper and lower journalling loops and having a forwardly projecting U-shaped panel loop in a vertical plane and adapted to swing over the post loop. To use the rack for loading a bag, the swing panels are locked in a plane orthogonal (normal) to the plane of the wall to which the wire rack is mounted, by simply slipping a snugly fitting tube of elastomeric material ("tubular lock") over the panel loop and post loop (within the panel loop). To ship the wire rack, the swing panels are unlocked from the mounting posts by removing the tubular locks. The spacer frame may be extended to include one or more intermediate mounting posts in each of which a swing panel is journalled, thus allowing two bags to be loaded simultaneously with a single intermediate mounting post; and, three bags to be loaded with two intermediate mounting posts, etc. the number of mounting posts in a spacer frame being one more than the number of bags to be simultaneously loaded.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the several views and in which:

FIG. 1 is a plan view of the wire rack used for loading a single plastic bag (not shown), showing the swing panels in a folded position in phantom outline, which panels are swung outwards into a bag-loading position at right angles to the spacer frame of the rack which is to be mounted on a wall.

FIG. 2 is a front elevational view of the wire rack of FIG. 2 showing details of the vertical posts at each end of the spacer frame.

FIG. 3 is a side elevational view of the wire rack of FIG. 2 showing a portion of the plastic bag in phantom outline, and particular details of the post loop and panel loop which together are held together by a tubular lock (not shown) to maintain the swing panels in a bag-loading position.

FIG. 6 is a detail of a prior art vertical mounting post showing sheet metal journals welded to a single piece of wire stock, and a plastic tube which serves to lock the swing panel in position.

FIG. 7 is a front elevational view of the detail shown in FIG. 6, showing the essential features of the vertical mounting post which was provided at each end of a spacer frame.

DETAILED DESCRIPTION OF PREFERRED EMBODIMENTS

Figure 4:
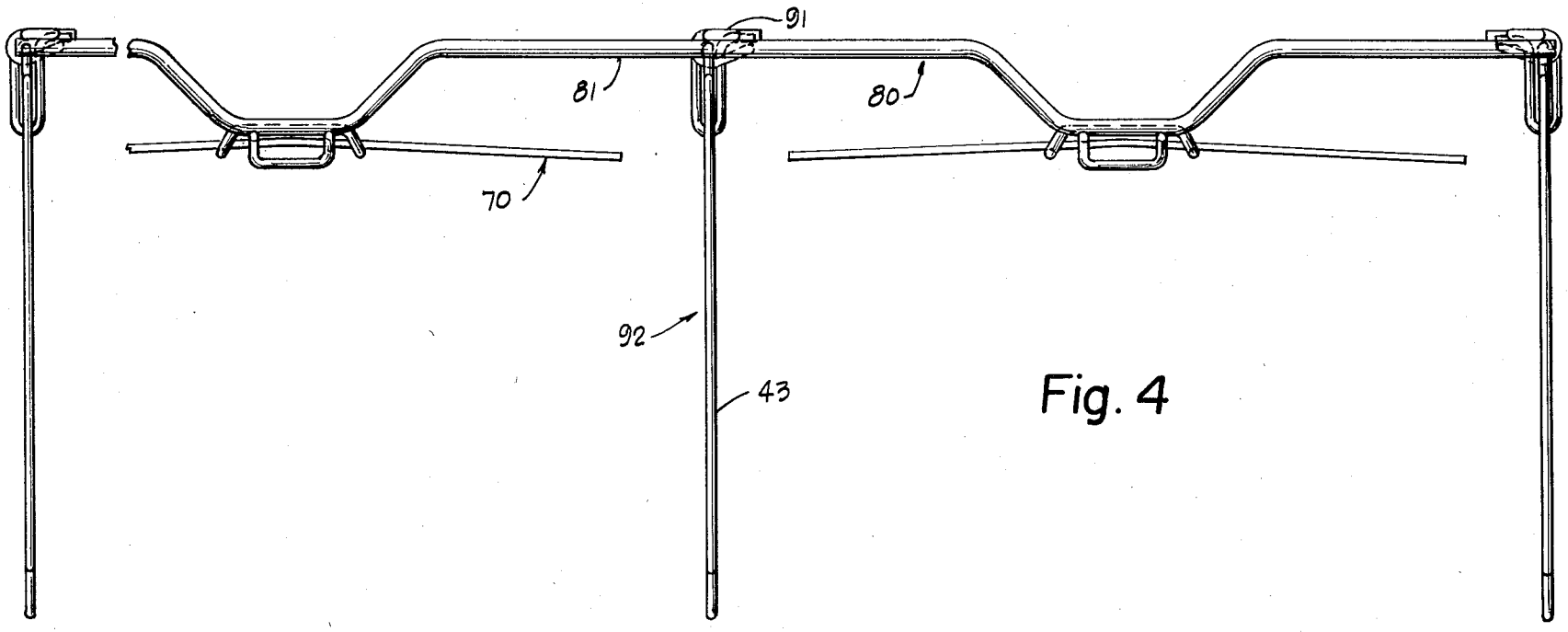
FIG. 4 is a plan view of the wire rack used for loading two plastic bags, showing the swing panels swung outwards in the bag-loading position, the center swing panel being used as a common panel for supporting the two bags (not shown) to be loaded.

Individual bag structures, suitable for use in the practice of this invention, include those described in U.S. Pat. No. 3,180,557, and in German Gebrauchsmuster No. 1,844,267, inter alia, the disclosures of which are incorporated by reference as if fully set forth herein. Such plastic bags are desirably side gusseted, and may be formed from a gusseted flattened tube of thermoplastic material such as polyethylene. The gusseted flattened tube is heat sealed and severed along lengths of the tube which correspond to the height of the bag. One heat sealed and severed end is cut out in a generally U-shaped configuration intermediate the gusseted areas therein, forming an open bag mouth with loop handles on opposite sides thereof. These plastic bags are commonly used at present, details of their structure are well known, and need not be described herein or illustrated in greater detail for the purposes at hand.

A single-bag wire rack indicated generally by reference numeral 10 and illustrated in FIGS. 1–3, comprises only a spacer frame indicated generally by reference numeral 20, and left and right swing panels 41 and 42 respectively, but no base for supporting a bag 50 when it is filled, since the spacer frame 20 is mounted to a vertical surface such as a wall. The spacer frame comprises upper and lower wire frame members 21 and 22 respectively, which are resistance welded near their ends to left and right vertical mounting posts 31 and 32 respectively, held in spaced apart, substantially mirror image relationship with one another by the spacer frame.

It is helpful for the trouble-free loading of bags, to provide a bulge in the central portion of the spacer frame. Such a bulge is conveiently provided by upper and lower arcuate central portions 23 and 24 respectively of the wire members 21 and 22 which are bent so as to project forward identically, one above the other. A bag-storage and support assembly, indicated generally by reference numeral 60, includes a vertical tab portion 61 with a forward protruding tab portion 62. The vertical portion 61 is resistance welded to the upper and lower wire members 21 and 22 to maintain their parallel configuration, to stiffen them, and to provide support for unopened bags stored on the rack prior to being used The bag-storage assembly 60 also includes a generally horizontal wire keeper 63 which is rectangular in shape with the vertical side portions 64 and 64' biased forward from the plane in which the vertical tab portion 61 lies. The keeper 63 is resistance welded to the vertical tab portion 61 at the four points where the wire members of each overlap. A resilient strip 65, preferably of a synthetic resinous material about 2 mm to 8 mm thick, is inserted through the upturned members 64 and 64'. When unopened bags are stacked on the tab portion, they are provided (by strip 65) with a backing against which they may rest, thus minimizing the risk of having articles loaded in the bag protruding towards the rear, thus distending the bag and causing it to be lodged against the spacer frame. As will now be evident, the bag storage assembly is not essential for enabling one to load a bag with groceries, or the like, but it aids in the uneventful loading of the bag.

The vertical mounting posts 31 and 32 are each constructed from two pieces of wire. A first single piece is bent to form multiple loops including upper mounting loop 33 and lower mounting loop 34; it is further bent to provide upper and lower journalling loops 35 and 36 respectively which are connected by a central vertical portion 37. The upper and lower mounting loops 33 and 34 are formed to lie in a vertical plane so they will abut the vertical surface to which the wire rack is mounted by mounting screws (not shown) or other fastening means. As illustrated, the mounting loops are generally elliptical and elongated. The upper and lower wire frame members 21 and 22 overlie the mounting loops 33 and 34 respectively, and are resistance welded at each of the two points on each loop where the wire member overlies the mounting loop.

The journalling loops 35 and 36 are formed to lie in a horizontal plane and vertically spaced apart relative to each other by the vertical portion 37, to enable a swing panel 41 to be journalled in the loops 35 and 36.

Since the swing panel 41 is to be locked in a position normal (perpendicular) to the vertical plane, as illustrated in FIG. 3, the mounting post 31 is provided with a forward protruding post loop 38, formed in a horizontal plane intermediate the journalling loops, from a second piece of wire stock which is bent to allow it to be resistance welded at two points to the vertical portion 37, on the rear surface thereof, to minimize the stress on the welds.

In an analogous manner to that described hereinabove for mounting post 31, the mounting post 32 is provided with upper and lower mounting loops 33' and 34', journalling loops 35' and 36', connected by a vertical portion 37', and a post loop 38', except that post loop 38' is both laterally and vertically inverted relative to post loop 38, to allow it (38') to be welded to the rear of the vertical portion 37'. Hence, the structural features of vertical mounting post 32 are stated to be formed in substantially mirror image relationship with the corresponding structural features of mounting post 31.

Swing panels 41 and 42 are identically formed from continuous pieces of wire the ends of which are butt-welded to provide a smooth continuous loop multiply bent so the loop is in one plane to provide a tab-shaped horizontal upper portion 43 to engage the integral handle loops of the plastic bag; each swing panel further includes a lower portion 44, downwardly inclined from the horizontal at an angle $\theta$ less than 45°; and, still further includes a posterior vertical portion 45 journalled in the lower and upper journalling loops 36 and 35, which is bent to provide a forwardly projecting U-shaped panel loop 46 in a vertical plane and so positioned so as to allow the panel loop to be swung over the post loop 38. The swing panel may thus be swung through an arc of substantially 180° yet may be locked in position by locking the panel and post loops with a locking means, for example a poly(vinyl chloride) plastic or rubber tube 47 (shown in FIGS. 6 and 7) which is snugly fitted over the loops. The precise nature of the locking means is not narrowly critical, but an elastomeric tubular section does not present sharp edges likely to puncture a plastic bag, and is exceedingly convenient to use, whether to lock the panel in position, or to unlock it.

As will be evident, the angle $\theta$ is not critical but an angle greater that 45° results in using additional wire stock to form each swing panel, increasing the cost without a concomitant benefit. Steel wire stock having a diameter in the range from about 0.1875" (inch) to about 0.375" is preferred for constructing the rack, the larger diameter stock being chosen for the upper and lower wire frame members of the spacer frame, and progressively smaller diameters being chosen for the swing panels, vertical mounting posts and bag-storage and support assembly.

Figure 5:
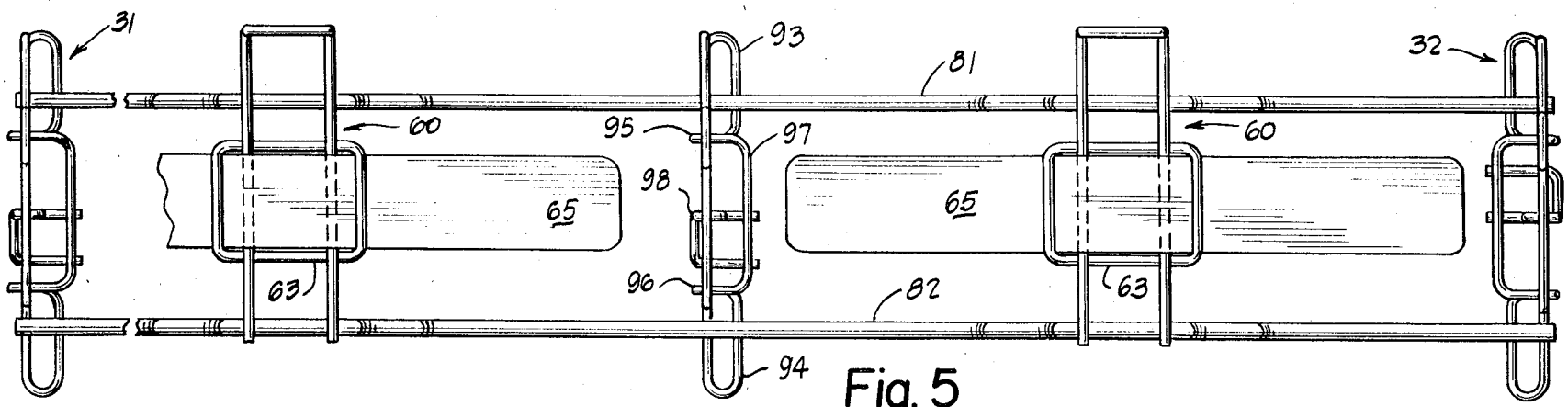
FIG. 5 is a front elevational view of the wire rack of FIG. 4 showing details of the structure analogous to those of the single bag wire rack.

Referring now to FIGS. 4 and 5 there is illustrated, with portions broken away, a two-bag wire rack indicated generally by reference numeral 70 which has the same construction as the wire rack 10, except that the rack 70 is adapted to hold two plastic bags (not shown) open for loading at the same time.

A spacer frame indicated generally by reference numeral 80 includes upper and lower wire frame members 81 and 82 each of which is resistance welded near its ends to left and right vertical mounting posts 31 and 32, but in addition also welded to another vertical mounting post referred to as intermediate post 91, midway between the posts 31 and 32, so that the rear surfaces of the three posts 31, 32 and 91 are coplanar. The post 91 has an analogous construction to that of either posts 31 or 32, since it is not critical which of the particular (substantially mirror image) constructions is used.

As illustrated, each wire frame member 81 and 82 is bent to provide two arcuate forwardly projecting portions, one on either side of the intermediate post 91 and midway between it (91) and each post 31 and 32. The intermediate mounting post 91 has upper and lower mounting loops 93 and 94, upper and lower journalling loops 95 and 96, a vertical portion 97, and a post loop 98, corresponding to the same elements in post 31, but are given different reference numerals simply to emphasize the identical correspondence of the structural elements.

In addition to left and right swing panels 41 and 42, an intermediate swing panel 92, substantially identical in shape and size to swing panels 41 and 42, is journalled in the journalling loops 95 and 96 of the intermediate post 91, so that all swing panels have the uppermost edges of their tab-shaped horizontal portions 43 aligned in the same horizontal plane. Bag-storage assemblies 60 are provided on either side of the intermediate post, and are resistance welded to the spacer frame in a manner similar to that described in FIGS. 1–3. Since the correspondence of the essential features of the rack 70 and the rack 10 are quite evident, no useful purpose is served by identifying each of the structural elements in detail.

Referring now to FIG. 6 there is shown a detail side elevational view, with portions broken away, of a prior art wire rack having a spacer frame terminated with left and right mounting posts, only the left mounting post indicated generally at 101 being shown in the drawing. The post 101 was a single piece of linear wire stock which terminated in upper and lower mounting loops 102 and 103 respectively, and upper and lower wire frame members 104 and 105 of the spacer frame were resistance welded immediately beneath the upper mounting loop 102, and above the lower mounting loop 103. Midway between the upper and lower wire frame members was welded a U-shaped post loop 106, the welds being made on either side of the vertical portion of the post 101, and the post loop 106 being formed in a horizontal plane. Intermediate the post loop and each wire frame member were welded upper and lower journalling clips 107 and 108 respectively, of sheet metal. Each clip comprised a substantially double-barrelled piece of sheet metal bent to tightly accomodate the vertical post in one barrel, and to rotatably accomodate the posterior vertical portions 109 of the swing panel 41 which was identical to swing panel 41 described in FIG. 3, and also provided with a panel loop 46 which could be swung over the post loop 103, in substantially the same manner as described for FIGS. 1–3. The panel 41 was locked in the bag-loading position with a piece of plastic tubular stock 47 which snugly fitted around the panel and post loops, as seen more clearly in FIG. 7. The main stress was thus on the weldments which joined the sheet metal of the journalling clip to the vertical post, and with continued use, failure of these weldments occurred more frequently than was acceptable. The wire rack of my invention has essentially eliminated failures due to stress at weldments because the construction of my rack is such that there is very little stress at such locations, particularly when compared to the amount of stress generated at the journalling loops.

I claim:

1. A wall-mountable wire rack for holding a plastic bag open by its oppositely disposed integral handle loops so that the bag may be loaded, said wire rack comprising, (a) left and right vertical mounting posts each comprising a first single piece of wire forming multiple loops including (i) upper and lower mounting loops adapted for mounting said rack on a vertical wall, and, (ii) upper and lower single journalling loops, each in a horizontal plane and vertically spaced apart relative to each other, one on either side of a U-shaped post loop; and, a second piece of wire welded to said first piece, said second piece forming (iii) said U-shaped post loop lying in a horizontal plane and projecting forward at a location intermediate said upper and lower mounting loops;

(b) a spacer frame including upper and lower parallel wire frame members, the upper wire frame member welded near each end at two points to each said upper mounting loop of said mounting posts, and the lower wire frame member welded near each end at two points to each said lower mounting loop of said mounting posts, so as to maintain said mounting posts in horizontally spaced apart relationship with each other; and, (c) left and right swing panels, each swing panel comprising a single piece of wire forming a continuous loop bent to provide (i) a tab-shaped horizontal upper portion to engage a handle loop of the plastic bag, (ii) a lower portion, downwardly inclined from the horizontal at an angle less than 45°; and, (iii) a posterior vertical portion journalled in said upper and lower journalling loops and having a forwardly projecting U-shaped panel loop in a vertical plane and adapted to swing over said post loop; and, (d) locking means to lock said post loop and panel loop together.

2. The wire rack of claim 1 wherein said upper and lower wire frame members are bent to provide forward protruding arcuate central portions, in vertically spaced apart relationship, and, a bag-storage and support assembly is fastened to said arcuate central portions to stiffen and strengthen said spacer frame.

3. The wire rack of claim 1 including in addition, at least one intermediate vertical mounting post having essentially the same structure as one of said left and right vertical posts and disposed therebetween, said intermediate post having swingably disposed thereon an intermediate swing panel essentially identical to said left and right panels, said intermediate panel being so positioned as to function as a common support for adjacent bag handles when the bags are to be loaded simultaneously; and, locking means to lock said intermediate panel to said intermediate post so that said intermediate panel is orthogonal to the vertical plane in which said intermediate and left and right posts lie.

4. The wire rack of claim 3 wherein said wire frame members are bent to provide plural forward protruding arcuate portions, each said portion of the upper frame member directly above and spaced apart from the portion of the lower frame member between the intermediate post and said left and right posts.

* * * * *